US005349148A

United States Patent [19]

Hung

[11] Patent Number: 5,349,148

[45] Date of Patent: Sep. 20, 1994

[54] CONTROL SWITCH FOR ELECTRIC WINCH CABLE

[76] Inventor: Michael Hung, 9-16, Nan Kan Hsia, Nan Kan, Lu Chu Hsiang, Tao Yuan County, Taiwan

[21] Appl. No.: 109,056

[22] Filed: Aug. 19, 1993

[51] Int. Cl.[5] ..... H01H 13/14

[52] U.S. Cl. ..... 200/562; 200/553; 200/557; 200/243

[58] Field of Search ..... 200/530, 553, 556, 557, 200/562, 237, 238, 239, 243, 244, 245, 246, 247, 248, 339, 6 R, 4

[56] References Cited

U.S. PATENT DOCUMENTS 2,057,536 10/1936 Nero ..... 200/562
4,652,706 3/1987 Rao et al. ..... 200/6 R
4,689,450 8/1987 Sawada ..... 200/6 R

*Primary Examiner*—Henry J. Recla
*Assistant Examiner*—David J. Walczak
*Attorney, Agent, or Firm*—Wenderoth, Lind & Ponack

[57] ABSTRACT

A control switch for controlling the coiling and uncoiling of an electric winch cable has a push button installed on a top cover of the switch. Both sides of the push button have a retaining pin, and its bottom is an appropriate V-shaped surface. Both edges of the V-shaped surface have a conducting plate. The conducting plates to a dc voltage source on the bottom cover of the switch are arranged to cross each other, with a lateral contacting plate in between. The top of the contacting plate has a supporting post at each end, and the bottom has two retaining posts such that the push button is snug with the retaining pins and the supporting post of the contacting plate. The conducting plates for motor wiring are arranged in parallel on both sides of the conducting plates for the dc voltage source. With such a configuration, pressing the push button to the left or the right changes the polarity of the dc voltage source so as to control the winch cable to coil or uncoil. When it stops, the motor wiring comes in contact with the conducting plates so that the twisting force of the motor shaft is increased. Therefore, when the switch is off, the motor shaft retards the rotation of the motor.

5 Claims, 6 Drawing Sheets

CONTROL SWITCH FOR ELECTRIC WINCH CABLE

BACKGROUND OF THE INVENTION

(a) Field of the Invention

The present invention relates to a control switch for an electric winch cable. More specifically, the present invention relates to a control switch which provides the function of coiling and uncoiling the cable used in the electric winch.

(b) Description of the Prior Art

Conventionally, the control of coiling and uncoiling of an electric winch cable is based on the polarity of the dc voltage applied. After hoisting the heavy object, a clutch is used to operate and control braking. However, such a structure requires a large braking force, and is therefore quite unsafe. In addition, motors used for electric winches are of a high current type, which generally overload and cause damage to the copper wiring.

SUMMARY OF THE INVENTION

The main object according to the present invention is to provide a control switch for controlling the coiling and uncoiling of an electric winch. Conducting plates in the switch are designed to be wide enough so as to be able to handle a motor which draws high current.

Another object according to the present invention is to provide a control switch for an electric winch in which conducting plates for a dc voltage source are arranged to cross each other and a lateral contacting plate is placed in between the two conducting plates. The conducting plates, connected to a motor, are arranged in parallel on two sides of the cover. A push button with a bottom V-shaped surface is used with the conducting plates such that the button can be pressed to the right or left hand side for controlling the polarity of the voltage and the operation of the electric winch. When the switch is off, the twisting force of the motor shaft is increased and the motor is therefore retarded to turn for coiling and uncoiling the winch cable.

BRIEF DESCRIPTION OF THE DRAWINGS

The drawings disclose an illustrative embodiment of the present invention which serves to exemplify the various advantages and objects thereof, and are as follows.

DETAILED DESCRIPTION OF THE PREFERRED EMBODIMENT

Figure 1:
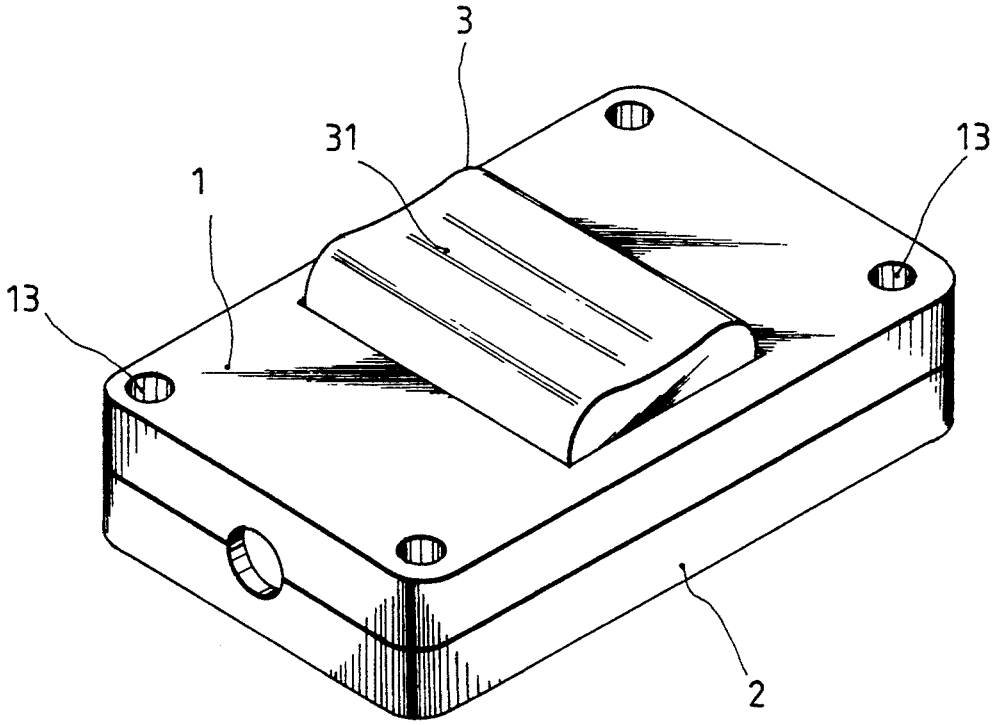
FIG. 1 is a perspective view of an assembly of a control switch for an electric winch according to the present invention.
Figure 2:
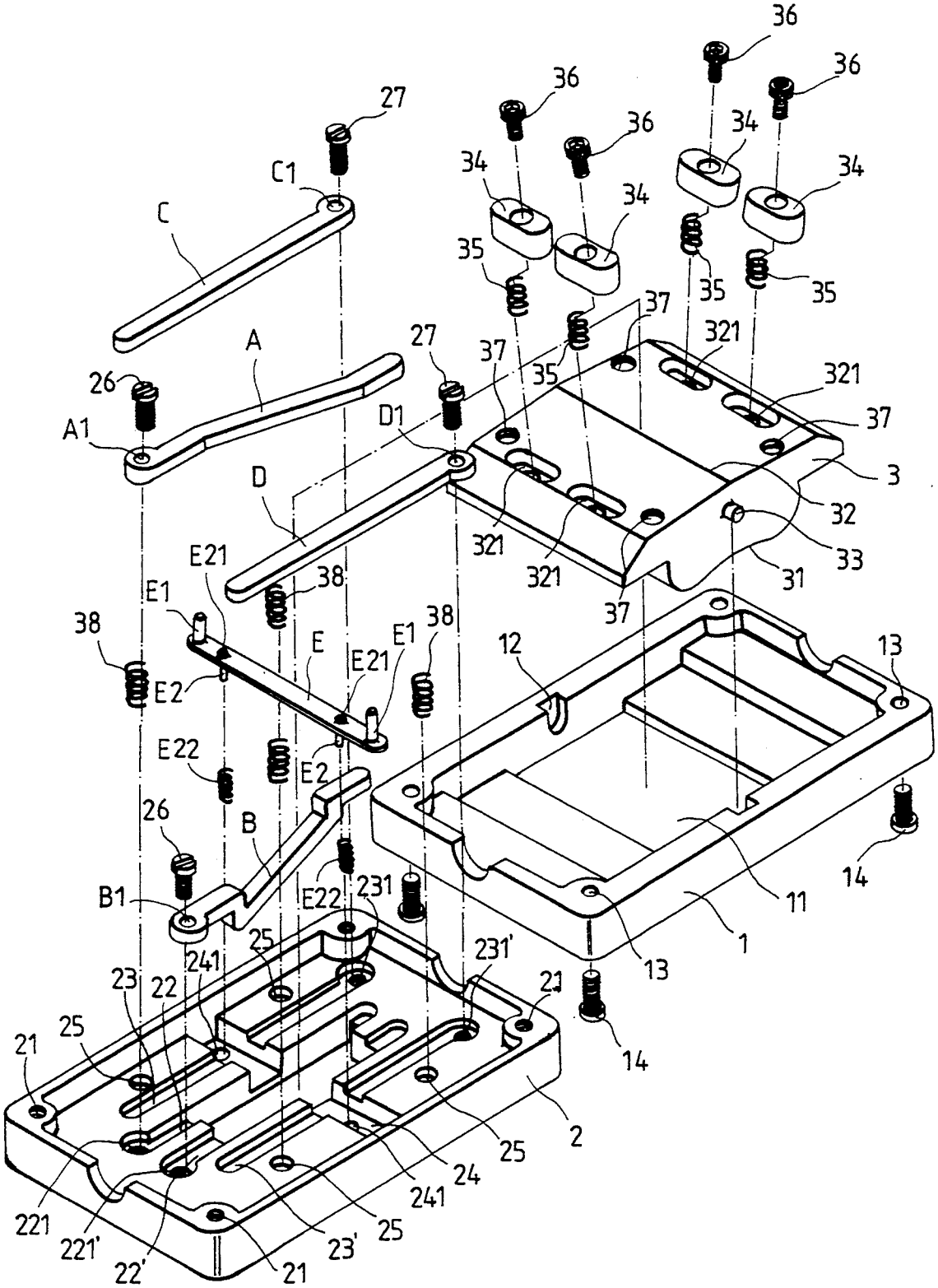
FIG. 2 is a fragmented perspective view of the switch for an electric winch according to the present invention.

As shown in FIGS. 1 and 2, the switch for controlling the coiling and uncoiling of the electric winch cable according to the present invention mainly consists of a top cover 1, a bottom cover 2, a push button 3, two copper conducting plates A and B used as terminals for 9 dc voltage source, two conducting plates C and D used as terminals for connecting to a motor, and a copper contacting plate E.

The top cover 1 has a hole 11 at its center for a switch knob. Both edges of the hole 11 have a positioning groove in their inner wall. The top cover 1 is of substantially rectangular shape, having a bolt hole 13 opened in each corner thereof. Each of the bolt holes 13 are designed for a bolt 14 to feed through so as to fasten the top cover 1 and the bottom cover 2 together.

The bottom cover 2 is configured to correspond with the top cover 1, having a bolt hole 21 opened in each of the four corners thereof. Each of the bolt holes 21 is used to secure the bottom cover 2 to the top cover 1. The inside surface of the bottom cover 2 has two elongated grooves 22 and 22' at the center and two other elongated grooves 23 and 23' along the two sides.

The center of the bottom cover 2 also has another groove 24 in the lateral direction. Screw holes 221, 221', 2231, 231' are opened at selected ends of each of the four elongated grooves 22, 22', 23 and 23', respectively. Also, in selected locations along both edges there are a plurality of spring positioning holes 25. In addition, the lateral groove 24 also has a spring positioning hole 241 in appropriate locations at both ends thereof The push button 3 has a top button surface 31 and a V-shaped bottom surface 32. Each side of the push button 3 has a retaining pin 33, and the V-shaped bottom surface 32 has a rabbet 321 on each edge. Each of the rabbet 321 are constructed to receive a copper conducting plate 34, which is secured inside the rabbet 321 by a screw 36. In addition, the V-shaped surface 32 has a plurality of spring positioning holes 37 that correspond to the spring positioning holes 25 of the bottom cover 2. The spring positioning holes 37 are used for the positioning of appropriate springs 38.

The two copper conducting plates A and B, which are used as terminals for a dc voltage source, are fabricated such that the copper conducting plate A is bent horizontally. One end of the copper conducting plate A has a lock hole A1. The other copper conducting plate B is bent horizontally and is also bent down perpendicularly. One end of the copper conducting plate B also has a lock hole B1. The two copper conducting plates A and B are arranged to cross each other to fit into the two elongated grooves 22 and 22' in the bottom cover 2, and they are secured by screws 26 at one end.

The two copper conducting plates C and D, which are mainly used as terminals for connecting to a motor, are substantially flat. First ends of the conducting plates C and D have lock holes C1 and D1. The conducting plates C and D are arranged to fit into the two elongated grooves 23 and 23' in parallel, and screws 27 are used to secure them at their first ends.

The copper contacting plate E is arranged to fit in between the conducting plates A and B, which are crossing each other. The top of the contacting plate E has a supporting post E1 at each end and the bottom has two retaining post E2. Each of the retaining post E2 extends upward and sticks out slightly from the top of the contacting plate E to form a protruded point of contact E21. The contacting plate E is arranged to fit into the lateral groove 24 of the bottom cover 2. Each of the retaining posts E2 has a spring E22 and is movably attached to the spring positioning hole 241 at one end of the lateral groove 24.

Figure 3:
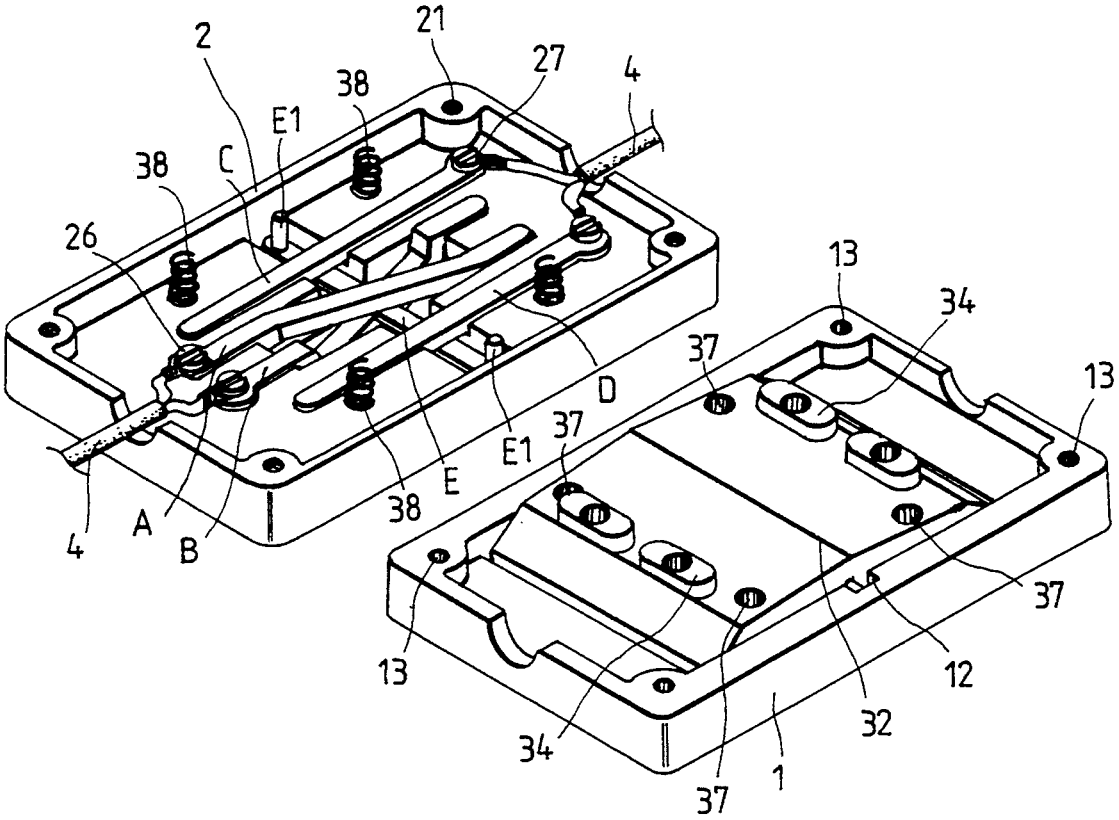
FIG. 3 is a perspective view of top cover and bottom cover assemblies of the switch according to the present invention.
Figure 4:
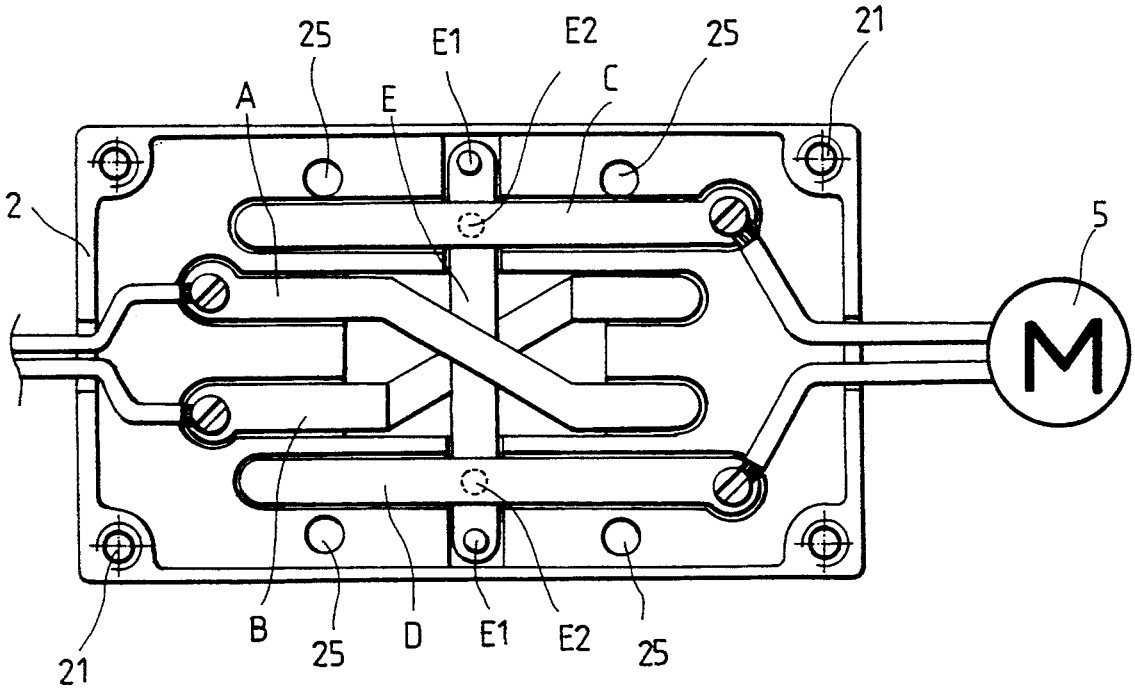
FIG. 4 is a front view of the bottom cover assembly of the switch according to the present invention.
Figure 5B:
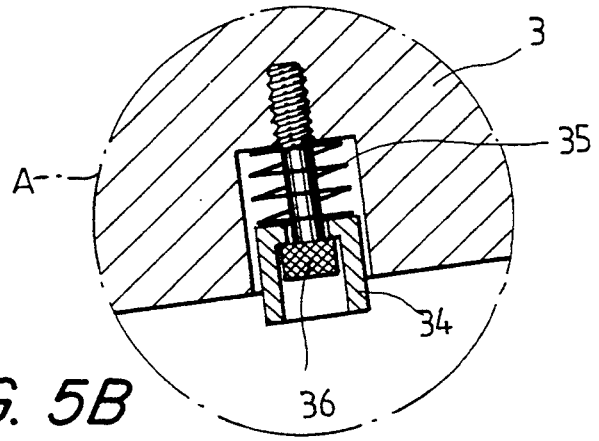
FIG. 5B is a partially exploded view of a portion of FIG. 5A.
Figure 5A:
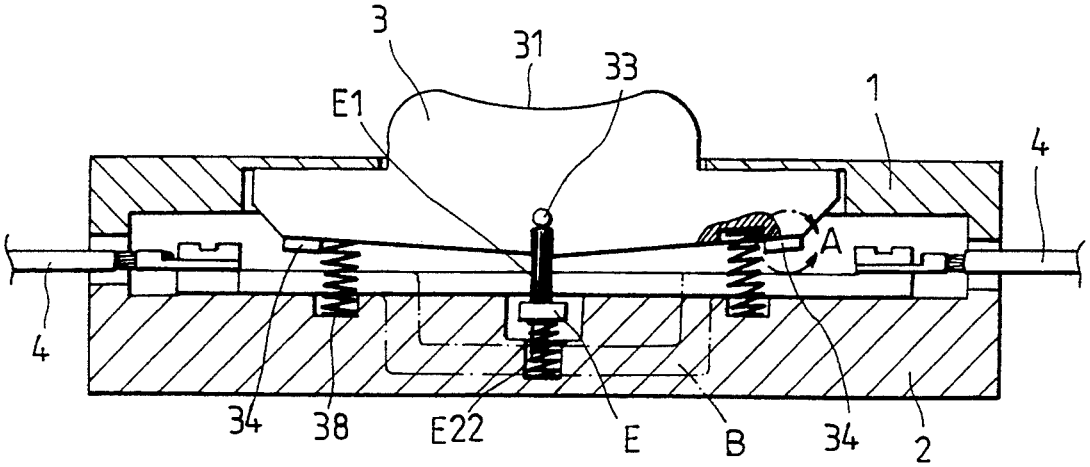
FIG. 5A is a cross section the switch according to the present invention.

In accordance with the aforesaid assembly, the two copper conducting plates A and B, which are used as the terminal for the dc voltage source, can be arranged to cross each other to fit into the central elongated grooves 22 and 22' of the bottom cover 2. The contacting plate E is placed in between the two conducting plates A and B. The conducting plates C and D for the motor are placed inside the elongated grooves 23 and 23' on both sides of the bottom cover 2. The conducting plates A, B, C and D are connected to electrical wire 4 and secured thereto, as is shown in FIGS. 3 and 4. This configuration allows the conducting plates A, B, C and D to have electrical connection with the dc voltage source and a motor 5. Also, springs 38 are loaded into the spring positioning holes 25 of the bottom cover 2 so that the top cover 1, with the push button 3, can be inserted and secured together.

Figure 6:
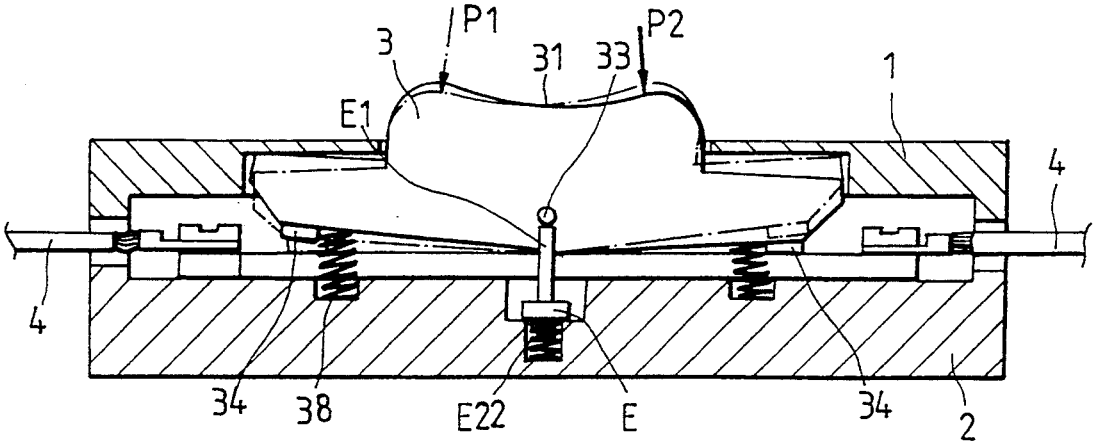
FIG. 6 is a diagrammatic view showing the operation of the switch according to the present invention.

By such configuration, the two retaining pins 33 on both sides of the button 3 butt against the supporting post E1 oil top of the lateral contacting plate E, as shown in FIG. The contacting plate E is now being pushed up by the spring E22 of the retaining post E2, enabling the protruded points of contact E21 of the contacting plate E to make an electrical contact with the conducting plates C and D of the motor. When the push button 3 is pressed to the right or the left hand side, as is shown in FIG. 6, the retaining pins 33 of the button 3 pushes the contacting plate E downward so as to be disengaged from the conducting plates C and D. The two conducting plates 34 on the bottom V-shaped surface 32 of the button 3 form two circuits through which the rotation of the motor 5 can be controlled.

When assembled for use, the control switch according to the present invention for controlling the coiling, uncoiling and stopping of the electric winch cable operates as follows:

1. When the push button 3 is pressed to the right hand side, as shown in the P1 direction in FIG. 6, the retaining pins 33 of the button 3 press the contacting plate E downward such that the contacting plate E disengages from the conducting plates C and D. The conducting plates 34 on one side of the button 3 comes in contact with the conducting plates B, C and A, D of the bottom cover 2, allowing the motor to rotate in a clockwise direction when power is applied. This is the operation of coiling the cable of the electric winch.

2. Similarly, when the push button 3 is pressed to the left hand side, as shown in the P2 direction in FIG. 6, the contacting plate E also disengages from the conducting plates C and D. The conducting plates 34 on the other side of the button 3 comes in contact with the conducting plates C, A and B, D respectively, forming another circuit which allows the motor to rotate in a counter-clockwise direction when power is applied. This is the uncoiling operation of the cable for the electric winch.

3. The push button 3 is snugged by the plurality of springs 38 of the bottom cover 2. When the pressing of the button 3 is released, the switch returns to its "OFF" state. It is in this "OFF" state that the protruded points of contact E21 of the contacting plate E comes in contact with the conducting plates C and D of the motor 5, respectively. The shaft of the motor 5 is now in a brake position. Thus, it is not easy for the external force to turn the motor and cause the danger of uncoiling the cable accidentally. Hence, the safety concern is assured.

Figure 7:
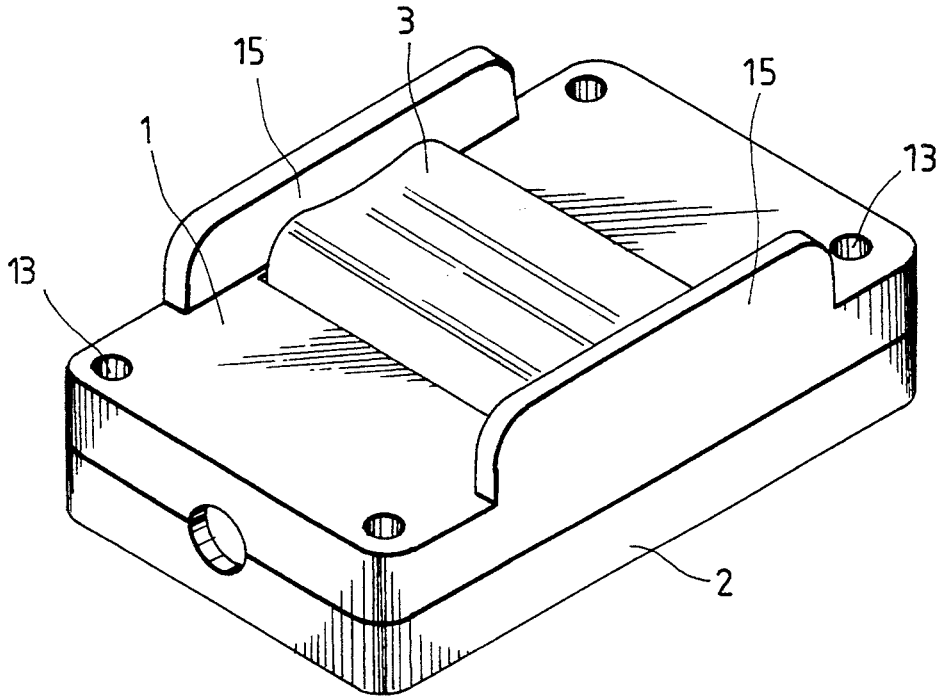
FIG. 7 is a perspective view of a top cover assembly having two blocking plates on both sides thereof.

In addition, to further assure that the button 3 of the switch will not be accidentally pressed, a shielding plate 15 is added to each side of the button 3 on the top cover 1, as shown in FIG. 7. Thus, the button 3 of the switch is guarded by the shielding plates 15 on both sides and will not be accidentally tripped by external means.

What is claimed is:

1. A control switch, comprising:

a top cover having a central hole, said central hole having an inner wall defining two opposite edges, said two opposite edges having respective positioning grooves;

a bottom cover mating with said top cover, said bottom cover having an inside surface, and said inside surface having edges, two central elongated grooves extending longitudinally at the center of said bottom cover, two side elongated grooves extending longitudinally at respective sides said central elongated grooves, a lateral groove extending laterally at the center of said bottom cover, a screw hole at one end of each of said central and side elongated grooves, a plurality of spring positioning holes along said edges of said inside surface, and a spring positioning hole at each end of said lateral groove;

a control button in said central hole of said top cover having a top button surface, a V-shaped bottom surface having opposite sides, opposite button sides each having a retaining pin, a plurality of first conducting plates securely mounted on said opposite sides of said V-shaped bottom surface, and a plurality of spring positioning holes in said V-shaped bottom surface corresponding to said plurality of spring positioning holes along said edges of said inside surface of said bottom cover;

a spring disposed in each of said spring positioning holes along said edges of said inside surface of said bottom cover and the corresponding said spring positioning holes of said V-shaped bottom surface;

two second conducting plates for connection to a DC voltage source, a first one of said second conducting plates having a lateral bend therein and one end provided with a lock hole, and a second one of said second conducting plates having a lateral bend therein, a downward bend therein and one end provided with a lock hole, wherein said second conducting plates are disposed in said two central elongated grooves so as to cross and are secured therein by screws engaging said lock holes thereof with said screw holes of said central elongated grooves;

two third conducting plates for connection to a motor, wherein each of said third conducting plates is substantially flat, has one end provided with a lock hole, is disposed in a respective one of said side elongated grooves parallel with the other of said third conducting plates and secured by a screw engaging said lock hole thereof with one of said screw holes of said side elongated grooves;

a contacting plate located in between said two second conducting plates and disposed in said lateral groove in said bottom cover, said contacting plate having a top having a supporting post at each end of said contacting plate and a bottom having two retaining posts, each said retaining post further protruding upwardly from said top, and each said retaining post having a spring thereon positioned in a said spring positioning hole of said lateral groove;

wherein said retaining pins on said button sides butt against said supporting posts on said contacting plate, and said control button is movable between an off position wherein said retaining posts of said contacting plate engage said third conducting plates and two on positions wherein said retaining posts are disengaged from said third conducting plates and said first conducting plates contact and connect each of said second conducting plates with a respective one of said third conducting plates.

2. The control switch of claim 1, wherein said V-shaped bottom surface of said control button has two rabbets in each of said opposite sides thereof, one of said first conducting plates being mounted in each said rabbet by a screw and a spring such that said first conducting plates are secured to said control button and biased away from said V-shaped bottom surface.

3. The control switch of claim 1, wherein both said top and bottom covers are substantially rectangular and have a bolt hole in each corner thereof, said top and bottom covers being fastened together by bolts extending through said bolt holes.

4. The control switch of claim 1, wherein said top cover further comprises a shielding plate on each side of said control button.

5. A control switch, comprising:

a housing having a central hole and an interior;

a control button pivotably mounted in said central hole of said housing, said control button being pivotable between a central off position and first and second on positions, said control button having a bottom surface facing said interior of said housing, and said bottom surface having a plurality of first conducting plates thereon;

two second conducting plates in said housing adapted to be connected to a DC voltage source, said second conducting plates extending in a longitudinal direction of said housing along the center of said housing such that said second conducting plates cross each other;

two third conducting plates in said housing adapted to be connected to a motor and extending in the longitudinal direction of said housing adjacent said second conducting plates; and a contacting plate having two contact points thereon biased into engagement with respective ones of said third conducting plates when said control button is in said off position;

wherein said control button is arranged such that when said control button is pivoted to the first on position, said contacting plate is disengaged from said third conducting plates and said first conducting plates engage said second and third conducting plates such that a first one of said second conducting plates is connected with a first one of said third conducting plates and the second one of said second conducting plates is connected with the second one of the third conducting plates, and when said control button is pivoted to the second on position, said contacting plate is disengaged from said third conducting plates and said first conducting plates engage said second and third conducting plates such the first one of said second conducting plates is connected with the second one of said third conducting plates, and the second one of said second conducting plates is connected with the first one of said third conducting plates.

* * * * *